US008342149B2

(12) United States Patent
Akiyama et al.

(10) Patent No.: US 8,342,149 B2
(45) Date of Patent: Jan. 1, 2013

(54) AIR INTAKE DEVICE FOR ENGINE

(75) Inventors: Hiroshige Akiyama, Miyagi (JP); Minoru Suzuki, Miyagi (JP); Toshiyuki Sugimoto, Miyagi (JP)

(73) Assignee: Keihin Corporation, Tokyo (JP)

( * ) Notice: Subject to any disclaimer, the term of this patent is extended or adjusted under 35 U.S.C. 154(b) by 673 days.

(21) Appl. No.: 12/065,057

(22) PCT Filed: Aug. 16, 2006

(86) PCT No.: PCT/JP2006/316093

§ 371 (c)(1),
(2), (4) Date: Dec. 30, 2009

(87) PCT Pub. No.: WO2007/026542

PCT Pub. Date: Mar. 8, 2007

(65) Prior Publication Data

US 2010/0139617 A1 Jun. 10, 2010

(30) Foreign Application Priority Data

Aug. 29, 2005 (JP) ..... 2005-247812

(51) Int. Cl.
*F02D 9/08* (2006.01)

(52) U.S. Cl. ..... 123/337; 123/336

(58) Field of Classification Search ..... 123/327, 123/328, 336, 337, 399, 400; 137/115.01, 137/487.5, 601.14, 601.16, 601.17
See application file for complete search history.

(56) References Cited

U.S. PATENT DOCUMENTS

| | | | | |
|---|---|---|---|---|
| 4,822,532 | A | 4/1989 | Suda et al. | |
| 6,158,417 | A | 12/2000 | Rauch et al. | |
| 2008/0280512 | A1 * | 11/2008 | Ozaki et al. | 440/1 |

FOREIGN PATENT DOCUMENTS

| | | | |
|---|---|---|---|
| JP | 2001-73813 | A | 3/2001 |
| JP | 2002-349396 | A | 12/2002 |
| JP | 2003-74444 | A | 3/2003 |

OTHER PUBLICATIONS

Translation by Machine of JP 2007 074444.*

* cited by examiner

*Primary Examiner* — John Kwon
*Assistant Examiner* — Johnny Hoang
(74) *Attorney, Agent, or Firm* — Arent Fox LLP

(57) ABSTRACT

An air intake device for an engine is provided that includes a throttle body (1), a throttle valve (5) that has a valve shaft (5*a*) rotatably supported on the throttle body (1), a throttle drum (8) connected to one end of the throttle valve (5), a throttle sensor (51) connected to the other end of the valve shaft (5*a*), a bypass (20) bypassing the throttle valve (5), and a bypass valve (25) that opens and closes the bypass (20), a bearing boss (3) supporting one end part, on the throttle drum (8) side, of the valve shaft (5*a*) being integrally and projecting provided on one side face of the throttle body (1), wherein the bypass (20) is formed so as to surround the bearing boss (3). This enables the air intake device for an engine to be made compact in spite of the bypass being present.

7 Claims, 8 Drawing Sheets

AIR INTAKE DEVICE FOR ENGINE

CROSS-REFERENCE TO RELATED APPLICATION

This application is a National Stage entry of International Application No. PCT/JP2006/316093, filed Aug. 16, 2006, the entire specification claims and drawings of which are incorporated herewith by reference.

TECHNICAL FIELD

The present invention relates to an improvement of an air intake device for an engine, the air intake device including a throttle body having an air intake path, a butterfly throttle valve that has a valve shaft rotatably supported on the throttle body and that opens and closes the air intake path, a throttle drum connected to one end of the valve shaft so as to open and close the throttle valve, a throttle sensor that is connected to the other end of the valve shaft and that detects a degree of opening of the throttle valve, a bypass connected to the air intake path while bypassing the throttle valve, and a bypass valve that opens and closes the bypass, a bearing boss supporting one end part, on the throttle drum side, of the valve shaft being integrally and projectingly provided on one side wall of the throttle body.

BACKGROUND ART

Such an air intake device for an engine is already known, as disclosed in Patent Publication 1.

[Patent Publication 1] Japanese Patent Application Laid-open No. 2003-74444

DISCLOSURE OF INVENTION

Problems To Be Solved By the Invention

In the conventional air intake device for an engine, since a control block is joined to a side of the throttle body opposite to the throttle drum, and a throttle sensor, an electronic control unit, and a bypass valve are concentrated on the control block, the control block has large dimensions, thus resulting in an increase in the overall dimensions of the device.

The present invention has been accomplished in the light of such circumstances, and it is an object thereof to provide an air intake device for an engine of the above type that can be made compact in spite of the bypass being present.

Means for Solving the Problems

In order to attain the above object, according to a first aspect of the present invention, there is provided an air intake device for an engine, comprising a throttle body having an air intake path, a butterfly throttle valve that has a valve shaft rotatably supported on the throttle body and that opens and closes the air intake path, a throttle drum connected to one end of the valve shaft so as to open and close the throttle valve, a throttle sensor that is connected to the other end of the valve shaft and that detects a degree of opening of the throttle valve, a bypass connected to the air intake path while bypassing the throttle valve, and a bypass valve that opens and closes the bypass, a bearing boss supporting one end part, on the throttle drum side, of the valve shaft being integrally and projectingly provided on one side wall of the throttle body, characterized in that the bypass is formed so as to surround the bearing boss and surround a return spring of the throttle drum, the return spring being mounted so as to surround the bearing boss.

According to a second aspect of the present invention, in addition to the first aspect, a bypass valve holder is joined to one side face of the throttle body, the bypass valve holder holding the bypass valve and also surrounding the bearing boss, and a groove-shaped recess is formed in at least one of opposing faces of the throttle body and the bypass valve holder, the groove-shaped recess forming at least part of the bypass.

According to a third aspect of the present invention, in addition to the second aspect, center lines of an inlet port and an outlet port of the bypass, which open in the air intake path, are made parallel to the axis of the valve shaft.

According to a fourth aspect of the present invention, in addition to the second aspect, groove-shaped recesses are formed in both opposing faces of the throttle body and the bypass valve holder, the groove-shaped recesses forming at least part of the bypass, and labyrinth walls are provided in the recesses, the labyrinth walls traversing the corresponding recesses at different positions from each other.

According to a fifth aspect of the present invention, in addition to the second aspect, a full closure regulation part is provided integrally with the throttle body, the full closure regulation part running through the bypass valve holder and projecting on the throttle drum side, and a fully closed position of the throttle valve is regulated by the full closure regulation part receiving the throttle drum.

According to a sixth aspect of the present invention, in addition to the second aspect, a throttle wire is connected to the throttle drum, the throttle wire pivoting the throttle drum, and a support part for supporting a guide tube slidably covering the throttle wire is formed on the bypass valve holder.

According to a seventh aspect of the present invention, in addition to the second or sixth aspect, a tubular wall covering an outer periphery of the throttle drum is formed integrally with the bypass valve holder, and a cover for closing an open face of the tubular wall is mounted on the tubular wall.

Effects of the Invention

In accordance with the first aspect of the present invention, since the space around the outer periphery of the bearing boss on the throttle drum side, which is conventionally considered to be dead space, is utilized effectively for formation of the bypass, it is possible to make the overall air intake device compact while preventing the dimensions of the area around the throttle sensor on the side opposite to the throttle drum from increasing.

In accordance with the second aspect of the present invention, even if the shape of the bypass is complicated, at least one part thereof can be formed easily at the same time as molding the throttle body or the bypass valve holder.

In accordance with the third aspect of the present invention, it becomes possible to machine the throttle body so as to coaxially form the inlet port and the outlet port and the shaft hole of the bearing boss, thereby contributing to a reduction in the number of machining steps.

In accordance with the fourth aspect of the present invention, it is possible to simply form a labyrinth in the bypass, and even when the engine blows back and the blown back gas flows backward in the bypass, carbon contained in the gas can be trapped in the labyrinth and thus prevented from entering the bypass valve.

In accordance with the fifth aspect of the present invention, even if the bypass valve holder is displaced to some degree, the fully closed position of the throttle valve can always be obtained accurately by abutment of the throttle drum against the full closure regulation part that is integral with the throttle body, regardless of the displacement.

In accordance with the sixth aspect of the present invention, the bypass valve holder also functions as a support member for supporting the end part of the guide tube of the throttle wire, thus reducing the number of components and the number of assembly steps.

In accordance with the seventh aspect of the present invention, the throttle drum and the area around the shaft end of the valve shaft are covered in a substantially hermetically sealed manner by the tubular wall of the bypass valve holder and the cover, thus providing protection against dust and water therefor and, moreover, since the tubular wall is formed on the bypass valve holder, it is possible to suppress any increase in the number of components and simplify the structure.

EXPLANATION OF REFERENCE NUMERALS AND SYMBOLS

Figure 1:
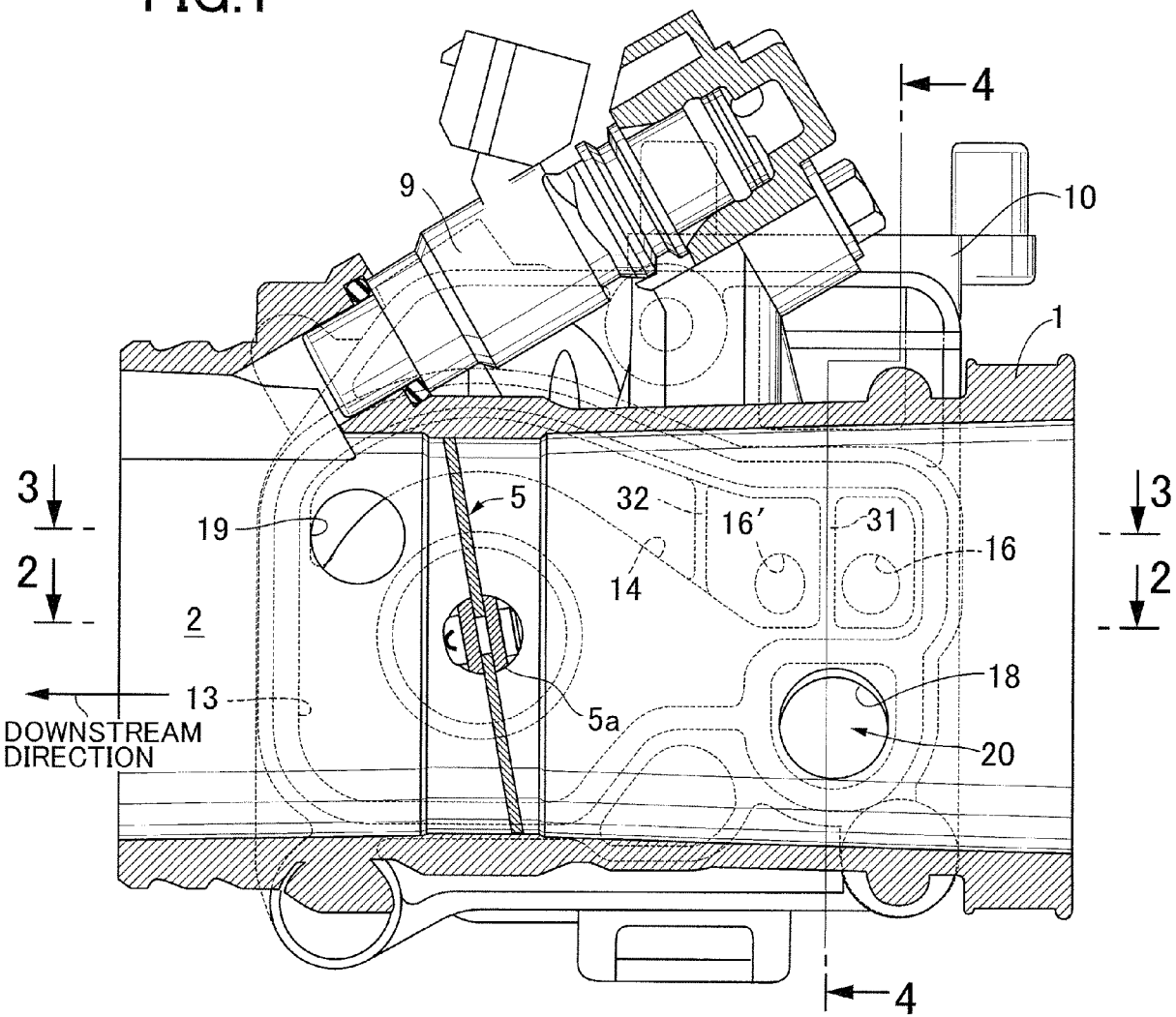
FIG. 1 is a sectional side view of an air intake device for an engine, related to the present invention (first embodiment).

1 Throttle body
2 Air intake path
3 Bearing boss (first bearing boss)
5 Throttle valve
5*a* Valve shaft
8 Throttle drum
10 Bypass valve holder
13 Recess
14 Recess
18 Inlet port
19 Outlet port
20 Bypass
25 Bypass valve
31 Labyrinth wall
32 Labyrinth wall
37 Full closure regulation part
39 Tubular wall
40 Support part (support boss)
41 Throttle wire
42 Guide tube
45 Cover
51 Throttle sensor

BEST MODE FOR CARRYING OUT THE INVENTION

Modes for carrying out the present invention are explained below by reference to a preferred embodiment of the present invention shown in the attached drawings.

Embodiment 1

Figure 2:
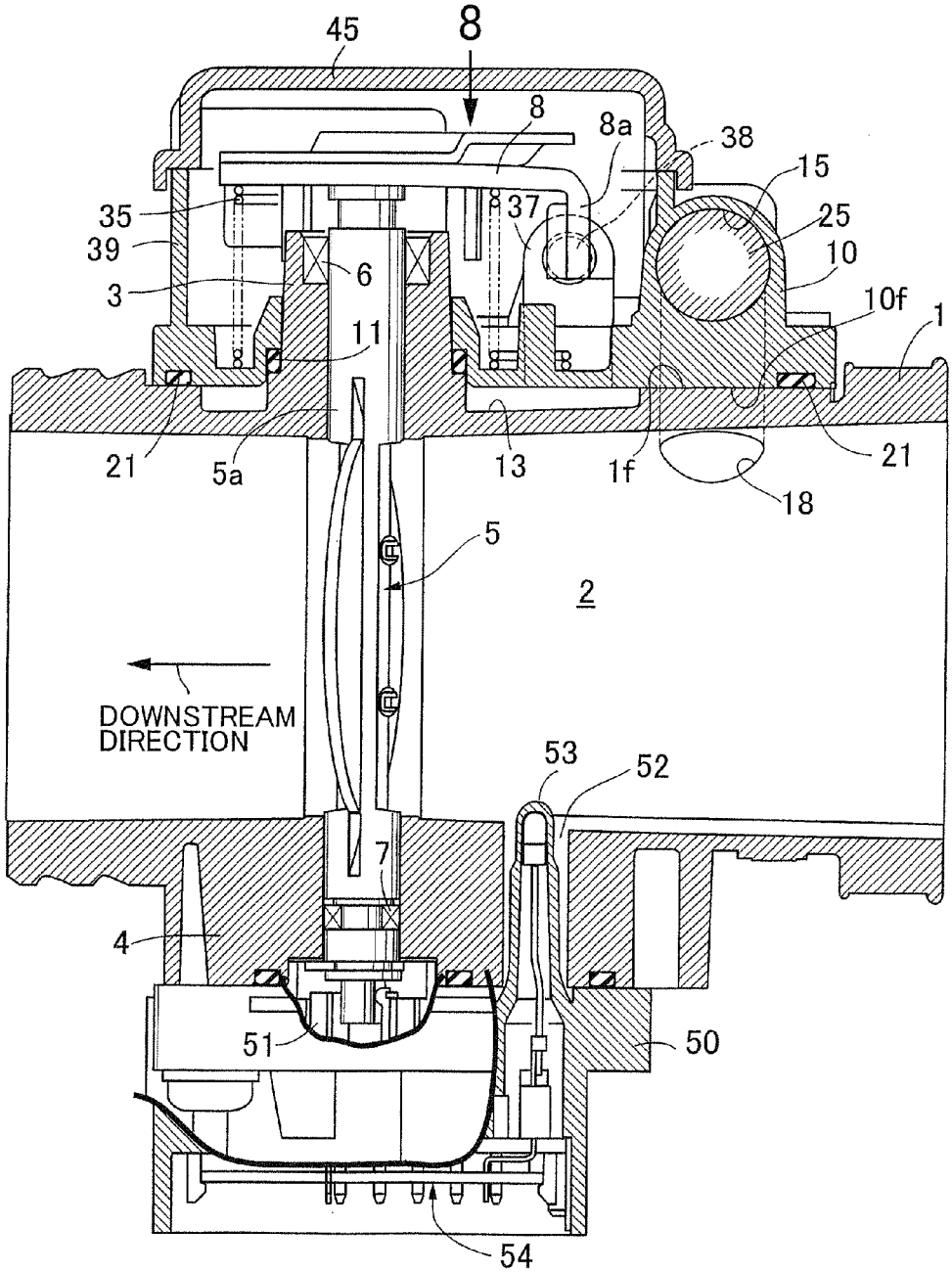
FIG. 2 is a sectional view along line 2-2 in FIG. 1 (first embodiment).
Figure 3:
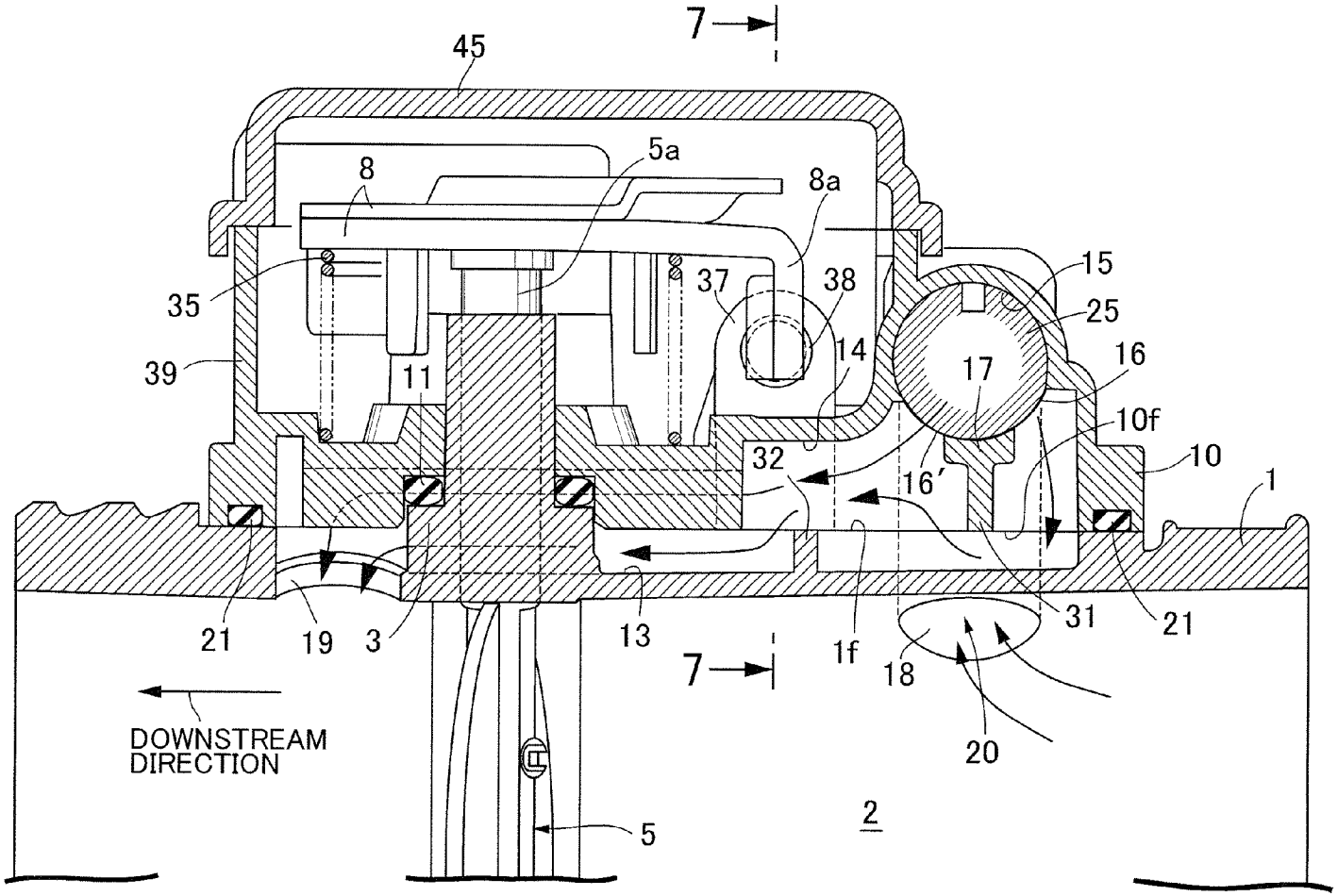
FIG. 3 is a sectional view along line 3-3 in FIG. 1 (first embodiment).

First, in FIG. 1 and FIG. 2, the air intake device for an engine of the present invention includes a throttle body 1 having a horizontal air intake path 2 communicating with an air intake port (not illustrated) of the engine. First and second bearing bosses 3 and 4 are formed in middle sections of opposing side walls of the throttle body 1 so as to project outward, a valve shaft 5*a* of a butterfly throttle valve 5 for opening and closing the air intake path 2 is rotatably supported by these bearing bosses 3 and 4, and the bearing bosses 3 and 4 are equipped with seals 6 and 7 respectively, which make intimate contact with the outer peripheral face of the valve shaft 5*a*. A throttle drum 8 is fixedly attached to one end portion of the valve shaft 5*a* projecting outward from the first bearing boss 3. Furthermore, a fuel injection valve 9 is mounted on an upper wall of the throttle body 1, the fuel injection valve 9 being capable of injecting fuel toward the air intake path 2 on the downstream side of the throttle valve 5.

As shown in FIG. 3 to FIG. 7, joined by a bolt to a side face of the throttle body 1 on the throttle drum 8 side is a bypass valve holder 10 extending around and fitted onto an outer periphery of the first bearing boss 3 via a seal 11, formed in a face 1*f* of the throttle body 1, opposing the bypass valve holder 10, is a groove-shaped first recess 13 surrounding the first bearing boss 3, and formed in a side face 10*f* of the bypass valve holder 10, opposing the throttle body 1, is a groove-shaped second recess 14 that passes above the first bearing boss 3 and is superimposed on an upper part of the first recess 13. Furthermore, formed in the bypass valve holder 10 are a vertically extending cylindrical valve chamber 15 and a pair of metering holes 16 and 16' (see FIG. 1, FIG. 3, and FIG. 6) for providing communication between a vertically middle section of the valve chamber 15 and one end part of the second recess 14. These metering holes 16 and 16' are arranged in the peripheral direction with a dividing wall 17 interposed therebetween.

A lower end part of the valve chamber 15 communicates with the air intake path 2 on the upstream side of the throttle valve 5 via an inlet port 18 (see FIG. 1 and FIG. 4) formed from the throttle body 1 to the bypass valve holder 10. Furthermore, the other end part of the first recess 13 communicates with the air intake path 2 on the downstream side of the throttle valve 5 via an outlet port 19 (see FIG. 1, FIG. 3, and FIG. 5) formed from the throttle body 1 to the bypass valve holder 10. In this arrangement, the inlet port 18 and the outlet port 19 are disposed so that center lines thereof are parallel to the axis of the first bearing boss. 3, 4. It is therefore possible to machine the throttle body 1 so as to coaxially form the inlet port 18, the outlet port 19, and a shaft hole of the first bearing boss 3, 4.

The inlet port 18, the valve chamber 15, the metering holes 16 and 16', the recesses 13 and 14, and the outlet port 19 thereby form a bypass 20 connected to the air intake path 2 while surrounding the first bearing boss 3 and bypassing the throttle valve 5. A seal 21 is provided between the opposing faces 1*f* and 10*f* of the throttle body 1 and the bypass valve holder 10 so as to surround the recesses 13 and 14, the inlet port 18, and the outlet port 19.

Figure 4:
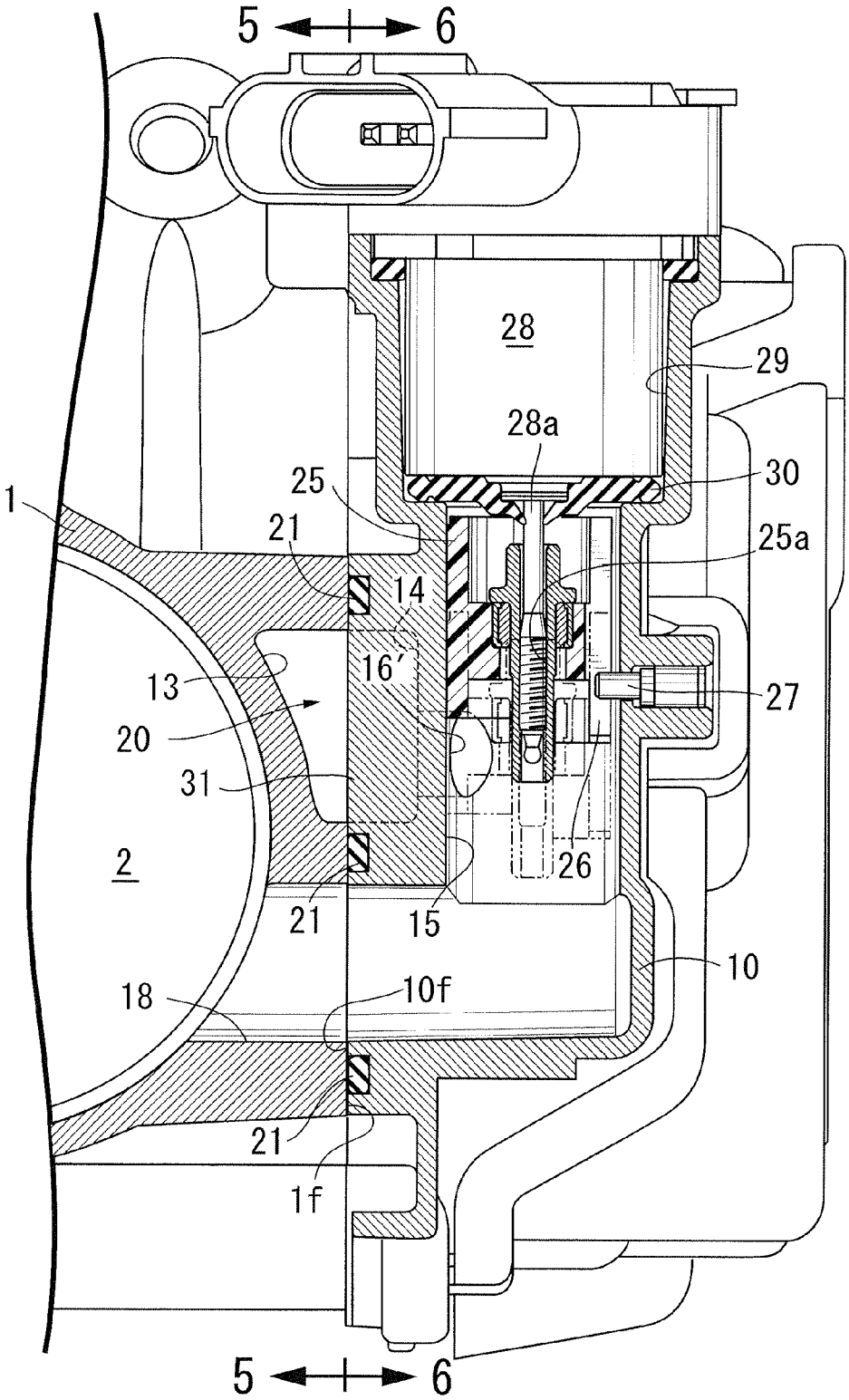
FIG. 4 is a sectional view along line 4-4 in FIG. 1 (first embodiment).
Figure 5:
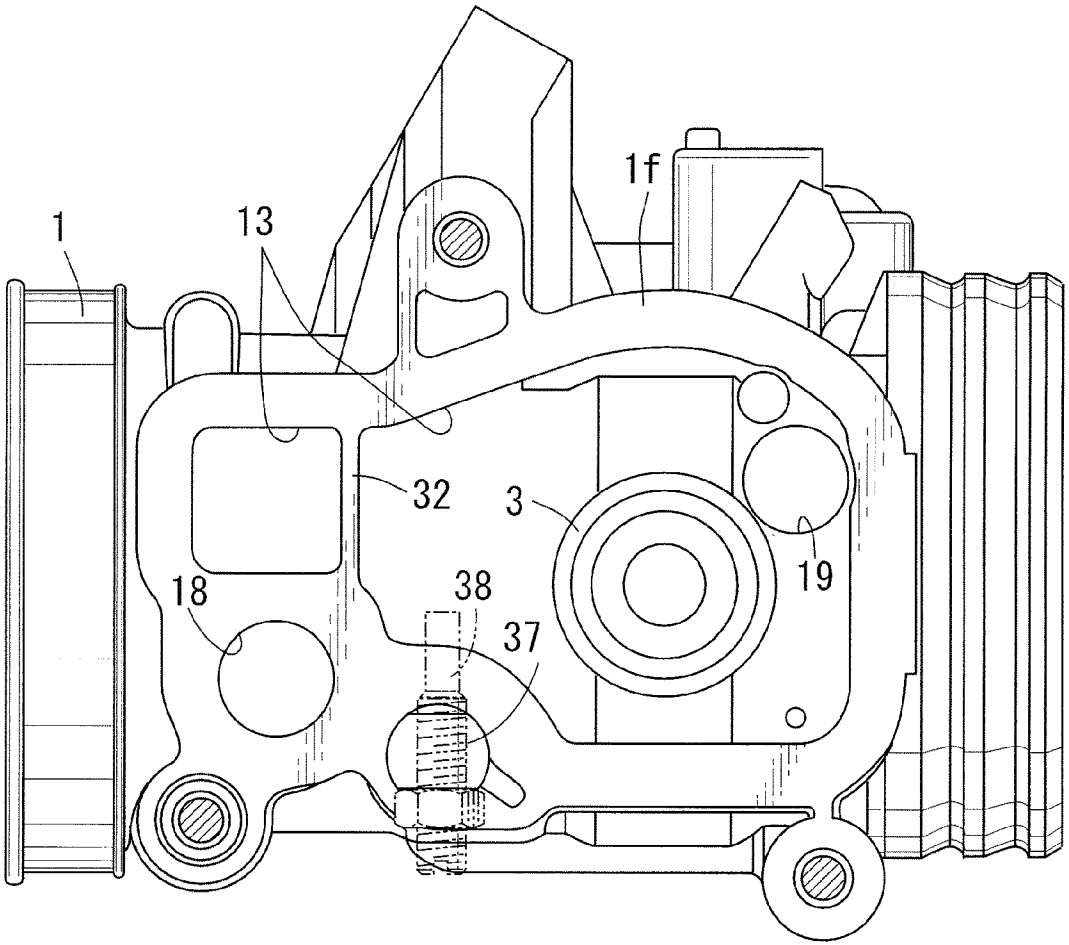
FIG. 5 is a sectional view along line 5-5 in FIG. 4 (first embodiment).
Figure 6:
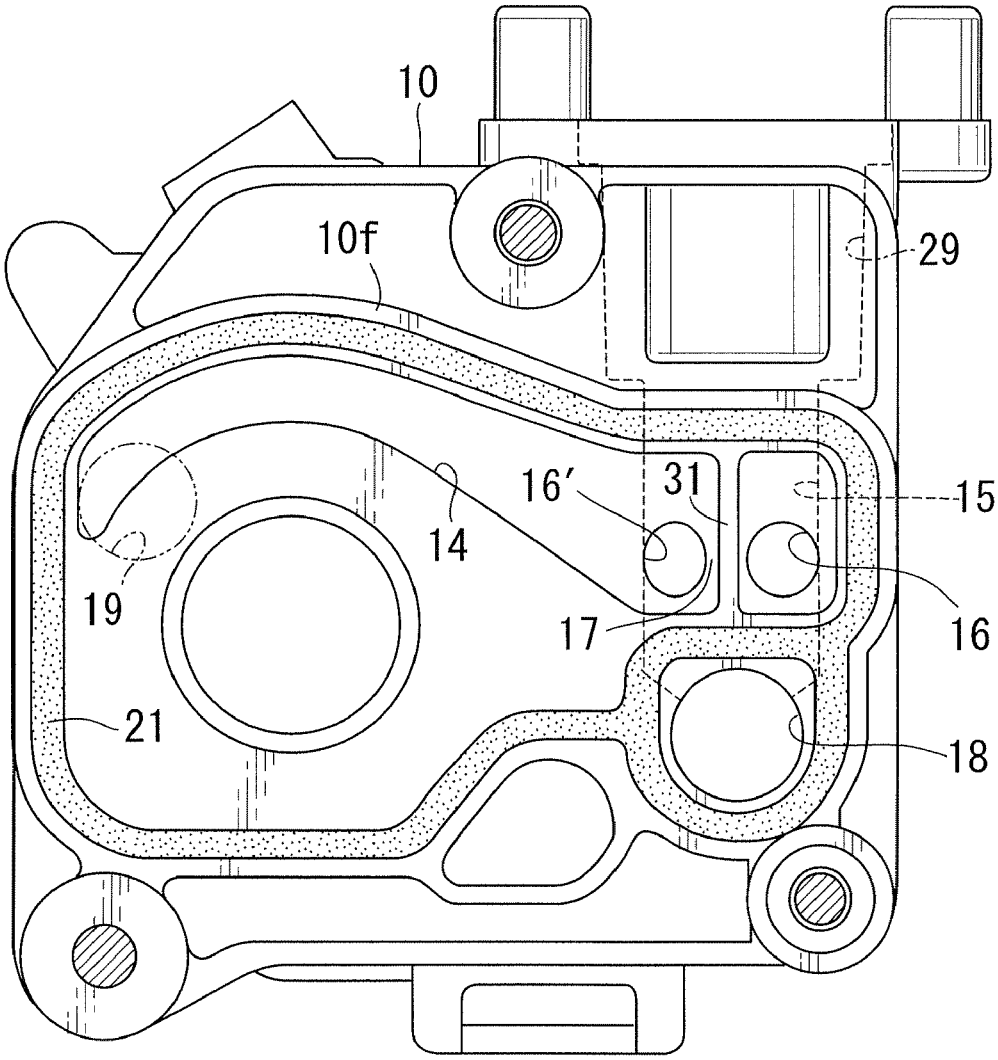
FIG. 6 is a sectional view along line 6-6 in FIG. 5 (first embodiment).
Figure 7:
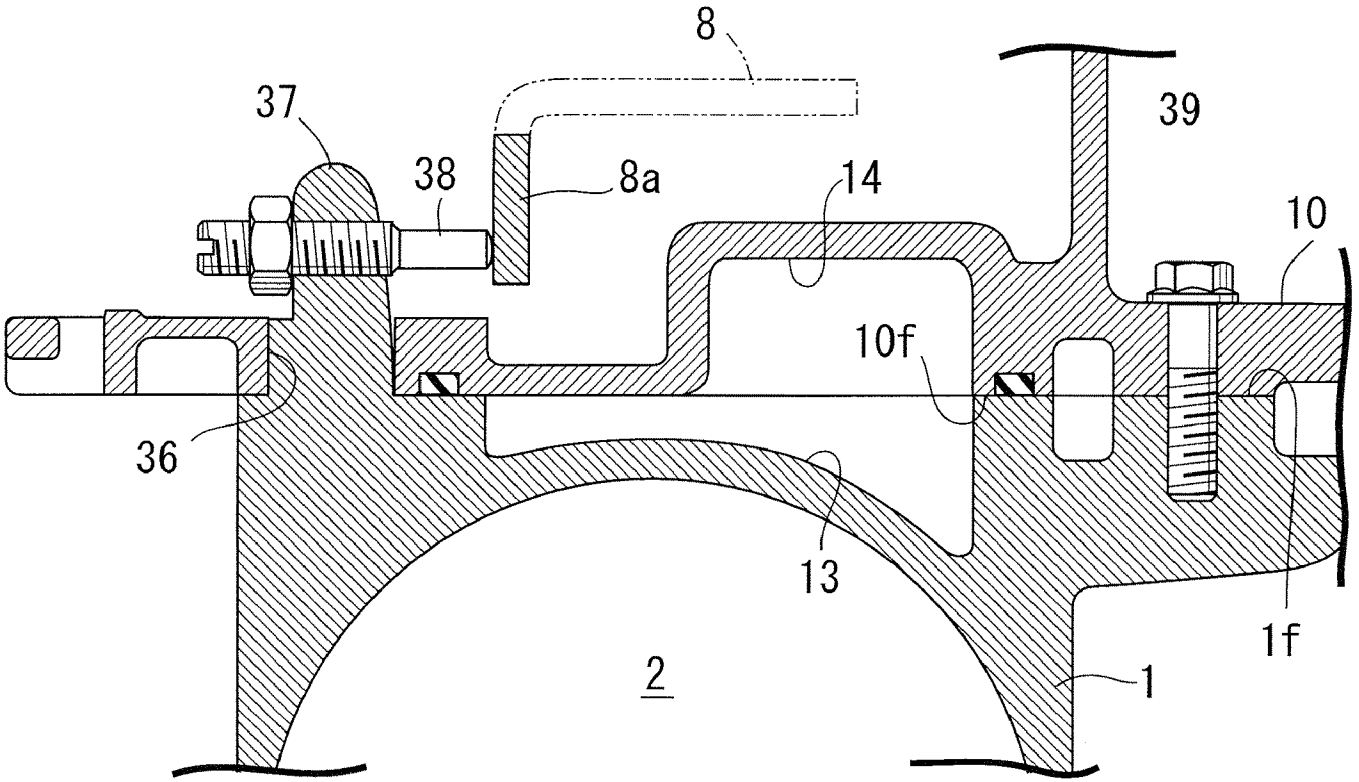
FIG. 7 is a sectional view along line 7-7 in FIG. 3 (first embodiment).

As clearly shown in FIG. 4, a piston-shaped bypass valve 25 for adjusting the degree of opening of the metering holes 16 and 16' from a fully closed state to a fully open state is slidably fitted into the valve chamber 15 from above, and in order to prevent the bypass valve 25 from rotating in this arrangement, a key 27 slidably engaging with a key groove 26 in the side face of the bypass valve 25 is mounted on the bypass valve holder 10. An electric actuator 28 for moving the bypass valve 25 for opening and closing is fitted into a mounting hole 29 formed in the bypass valve holder 10 so as to communicate with the upper end of the valve chamber 15, and is fixedly secured to the bypass valve holder 10. This electric actuator 28 has a downwardly projecting output shaft 28*a* screwed into a screw hole 25*a* in a center part of the bypass valve 25, and rotating the output shaft 28*a* forward and backward enables the bypass valve 25 to move up and down (open and close). A plate-shaped seal 30 is provided between a lower end face of the electric actuator 28 and a base face of the mounting hole 29, the seal 30 making intimate contact with an outer peripheral face of the output shaft 28*a*.

As shown in FIG. 1, FIG. 3, FIG. 5, and FIG. 6, a plurality (two in the illustrated example) of labyrinth walls 31 and 32 are formed on the throttle body 1 and the bypass valve holder 10 in a section where the first and second recesses 13 and 14 are superimposed upon each other, the labyrinth walls 31 and 32 being arranged alternately along the direction of flow of air while traversing the recesses 13 and 14. In this arrangement, the first labyrinth wall 31 on the bypass valve holder 10 side is provided so as to be connected to the dividing wall 17 between the pair of metering holes 16 and 16'.

Figure 8:
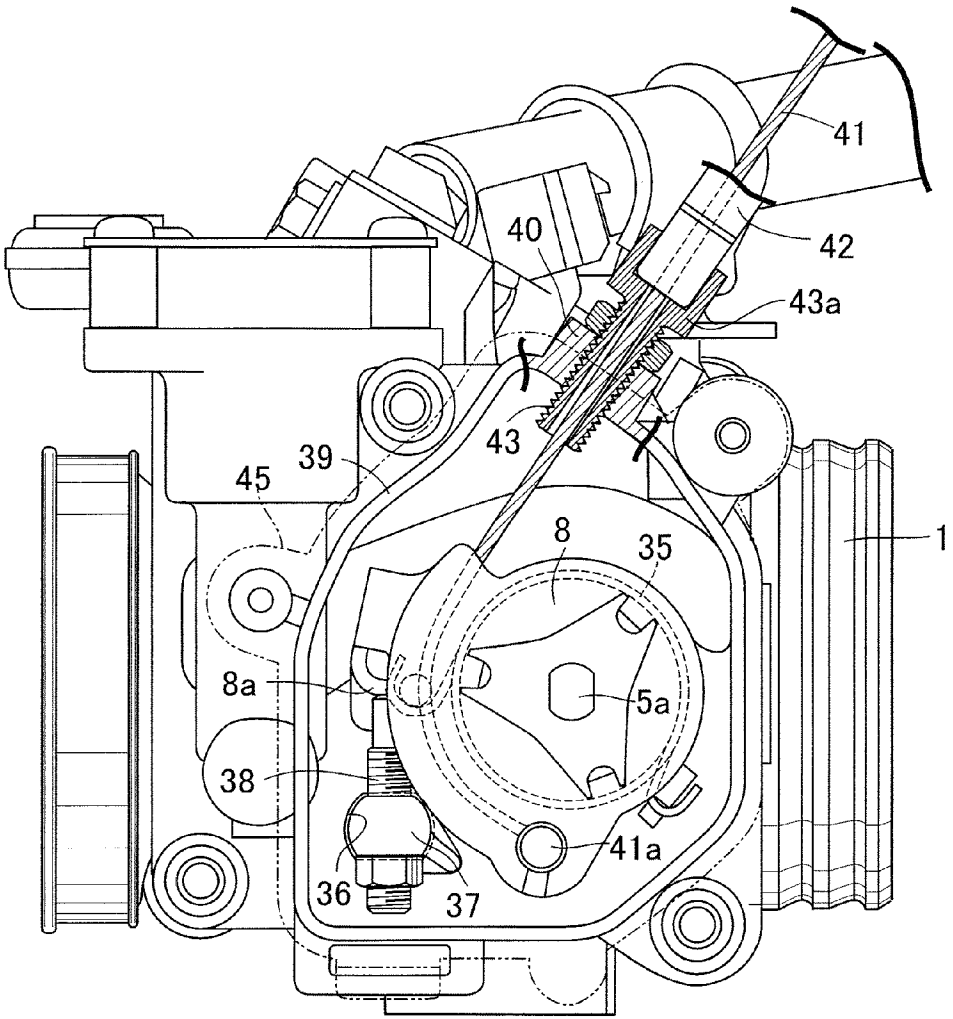
FIG. 8 is a view from arrow 8 in FIG. 2 (first embodiment).

In FIG. 2 and FIG. 8, a return spring 35, which is a torsion coil spring, urging the throttle drum 8 in a direction that closes the throttle valve 5 is mounted between the bypass valve holder 10 and the throttle drum 8 so as to surround the first bearing boss 3. Furthermore, a full closure regulation part 37 running through a through hole 36 of the bypass valve holder 10 and projecting toward the throttle drum 8 side is formed integrally with the throttle body 1, and a stopper bolt 38 adjustably screwed into a forward end part of the full closure regulation part 37 regulates a fully closed position of the throttle valve 5 by receiving a bent stopper piece 8*a* of the throttle drum 8.

Formed integrally with the bypass valve holder 10 is a tubular wall 39 surrounding the throttle drum 8 and being integrally equipped with a support boss 40 on one side, linked to the throttle drum 8 is a connection terminal 41*a* at one end of a throttle wire 41 running through the support boss 40, and linked to a throttle operation member such as a throttle grip (not illustrated) is a connection terminal at the other end of the throttle wire 41. A hollow bolt 43 through which the throttle wire 41 runs is adjustably screwed into the support boss 40, and an end part of a guide tube 42 slidably covering the throttle wire 41 is supported by a head portion 43*a* of the hollow bolt 43.

Pulling the throttle wire 41 by the throttle operation member enables the throttle valve 5 to be opened via the throttle drum 8, and releasing the pulling enables the throttle valve 5 to be closed by the urging force of the return spring 35.

A cover 45 for closing an open face of the tubular wall 39 is detachably retained on the tubular wall 39 by a screw.

Referring again to FIG. 2, a control block 50 covering an end face of the second bearing boss 4 is joined to the throttle body 1, and a throttle sensor 51 for detecting a degree of opening of the throttle valve 5 is formed between the control block 50 and the valve shaft 5*a*. Furthermore, provided in the control block 50 is a through hole 52 adjacent to the second bearing boss 4, and mounted on the control block 50 is a temperature sensor 53 running through the through hole 52 and having its forward end part facing the air intake path 2 on the upstream side of the throttle valve 5. Furthermore, mounted on the control block 50 is an electronic control unit 54 that receives detection signals from the throttle sensor 51, the temperature sensor 53, etc. and controls the operation of the electric actuator 28, the fuel injection valve 9, an ignition system, etc.

The operation of this embodiment is now explained.

When the engine is running, the electronic control unit 54 supplies to the electric actuator 28 a current corresponding to an air intake temperature detected by the temperature sensor 53, thus operating the electric actuator 25 and thereby controlling the opening and closing of the bypass valve 25. When the engine is at a low temperature, that is, the engine is warming up, the bypass valve 25 is pulled up by a large amount, thus controlling the degree of opening of the metering holes 16 and 16' so that it is large. When the throttle valve 5 is in a fully closed state, the amount of fast idle air that is supplied to the engine through the bypass 20, that is, in sequence through the inlet port 18, the valve chamber 15, the metering holes 16 and 16', the first and second recesses 13 and 14, and the outlet port 19, is controlled so as to be relatively large by the degree of opening of the metering holes 16 and 16'; at the same time an amount of fuel corresponding to the air intake temperature is injected from the fuel injection valve 9 toward the downstream side of the air intake path 2, and the engine receives a supply of the fast idle air and the fuel, thus maintaining an appropriate fast idling rotational speed so as to accelerate the warming up.

When the engine temperature increases as warming up progresses, since the electric actuator 28 accordingly makes the bypass valve 25 descend, thus decreasing the degree of opening of the metering holes 16 and 16', the amount of fast idle air supplied to the engine through the bypass 20 decreases, and the engine fast idling rotational speed decreases. When the engine temperature reaches a predetermined high temperature, since the electric actuator 28 maintains the bypass valve 25 at a predetermined degree of idle opening, the engine can be put stably into a normal idling state when the throttle valve 5 is fully closed.

Since the bypass 20 is formed so as to surround the first bearing boss 3, which supports the end part of the valve shaft 5*a* on the throttle drum 8 side, the space around the outer periphery of the first bearing boss 3, which is conventionally considered to be dead space, is utilized effectively for formation of the bypass 20, and it is therefore possible to make the overall air intake device compact while preventing the dimensions of the area around the throttle sensor 51 on the side opposite to the throttle drum 8 from increasing.

Furthermore, since at least one part of the bypass 20 is formed from the groove-shaped recesses 13 and 14 formed in opposing faces of the throttle body 1 and the bypass valve holder 10, which are joined to each other, even if the shape of the bypass 20 is complicated, at least one part thereof can be formed easily at the same time as molding the throttle body 1 and the bypass valve holder 10.

Moreover, since the center lines of the inlet port 18 and outlet port 19 of the bypass 20, which open on the air intake path 2, are parallel to the axis of the valve shaft 5*a*, it is possible to machine the throttle body 1 so as to coaxially form the inlet port 18 and the outlet port 19 and the shaft hole of the bearing boss, thereby contributing to a reduction in the number of machining steps.

Furthermore, since, in order to form the bypass 20, a plurality of labyrinth walls 31 and 32 are provided on the groove-shaped recesses 13 and 14 formed in the two opposing faces 1*f* and 10*f* of the throttle body 1 and the bypass valve holder 10, the labyrinth walls 31 and 32 being arranged alternately along the direction of flow of air while traversing the recesses 13 and 14, it is possible to simply form a labyrinth in the bypass 20, and even when the engine blows back and the blown back gas flows backward in the bypass 20, carbon contained in the gas can be trapped in the labyrinth and thus prevented from entering the bypass valve 25.

Furthermore, since the full closure regulation part 37 running through the bypass valve holder 10 and projecting toward the throttle drum 8 side is formed integrally with the throttle body 1, and the fully closed position of the throttle valve 5 is regulated by means of the stopper bolt 38, which is screwed into the full closure regulation part 37, receiving the stopper piece 8*a* of the throttle drum 8, even if the bypass valve holder 10 is displaced relative to the throttle body 1 to some degree, the fully closed position of the throttle valve 5 can always be reproduced accurately regardless of the displacement.

Moreover, since the tubular wall 39 covering the outer periphery of the throttle drum 8 is formed integrally with the bypass valve holder 10, and the cover 45 is mounted on the open end of the tubular wall 39 so as to block it, the throttle drum 8 and the area around the shaft end of the valve shaft are covered in a substantially hermetically sealed manner by the tubular wall 39 of the bypass valve holder 10 and the cover 45, thus providing protection against dust and water therefor and, moreover, since the tubular wall 39 is formed on the bypass valve holder 10, it is possible to suppress any increase in the number of components and simplify the structure.

Furthermore, since the support boss 40 supporting the guide tube 42 of the throttle wire 41 is formed integrally with the tubular wall 39, the tubular wall 39, that is, the bypass valve holder 10, functions also as a support member for supporting the end part of the guide tube 42 of the throttle wire 41, thus reducing the number of components and the number of assembly steps.

Furthermore, since the metering holes 16 and 16', whose degree of opening is controlled by the bypass valve 25, are formed as a pair of separate metering holes 16 and 16' arranged in the peripheral direction of the valve chamber 15 with the dividing wall 17 interposed therebetween, the total opening area of the two metering holes 16 and 16' is large; even if the bypass valve 25 is drawn toward the metering holes 16 and 16' side by air intake negative pressure on the downstream side of the bypass 20 acting on the outer peripheral face of the bypass valve 25 through the two metering holes 16 and 16', since the outer peripheral face of the bypass valve 25 is supported by the dividing wall 17, it is possible to prevent effectively the outer peripheral face of the bypass valve 25 from being forced out toward the metering holes 16 and 16' side, thus guaranteeing a smooth opening and closing (up and down) movement of the bypass valve 25. It is therefore possible to supply a large volume of fast idle air by setting the total opening area of the two metering holes 16 and 16' sufficiently large.

An embodiment of the present invention is explained above, but the present invention is not limited thereto and may be modified in a variety of ways as long as the modifications do not depart from the spirit and scope of the present invention. For example, the present invention may be applied to a downdraft type throttle body having its air intake path standing vertically.

The invention claimed is:

1. An air intake device for an engine, comprising:

a throttle body having an air intake path;

a butterfly throttle valve that has a valve shaft rotatably supported on the throttle body and that opens and closes the air intake path;

a throttle drum connected to one end of the valve shaft so as to open and close the throttle valve;

a throttle sensor that is connected to another end of the valve shaft and that detects a degree of opening of the throttle valve;

a bypass connected to the air intake path and bypassing the throttle valve;

a bypass valve that opens and closes the bypass; and a bearing boss, supporting an end part, on the throttle drum side, of the valve shaft being integrally and projectingly provided on one side wall of the throttle body, wherein the bypass is formed so as to surround the bearing boss and surround a return spring of the throttle drum, the return spring being mounted so as to surround the bearing boss.

2. The air intake device for an engine according to claim 1, wherein a bypass valve holder is joined to one side face of the throttle body, the bypass valve holder holding the bypass valve and surrounding the bearing boss, and a groove-shaped recess is formed in at least one of opposing faces of the throttle body and the bypass valve holder, the groove-shaped recess forming at least part of the bypass.

3. The air intake device for an engine according to claim 2, wherein center lines of an inlet port and an outlet port of the bypass, which open in the air intake path, are made parallel to the axis of the valve shaft.

4. The air intake device for an engine according to claim 2, wherein groove-shaped recesses are formed in both opposing faces of the throttle body and the bypass valve holder, the groove-shaped recesses forming at least part of the bypass, and labyrinth walls are provided in the recesses, the labyrinth walls traversing the corresponding recesses at different positions from each other.

5. The air intake device for an engine according to claim 2, wherein a full closure regulation part is provided integrally with the throttle body, the full closure regulation part running through the bypass valve holder and projecting on the throttle drum side, and a fully closed position of the throttle valve is regulated by the full closure regulation part receiving the throttle drum.

6. The air intake device for an engine according to claim 2, wherein a throttle wire is connected to the throttle drum, the throttle wire pivoting the throttle drum, and a support part for supporting a guide tube slidably covering the throttle wire is formed on the bypass valve holder.

7. The air intake device for an engine according to claim 2 or 6, wherein a tubular wall covering an outer periphery of the throttle drum is formed integrally with the bypass valve holder, and a cover for closing an open face of the tubular wall is mounted on the tubular wall.

* * * * *